US010646771B1

(12) United States Patent
Jacobsma

(10) Patent No.: US 10,646,771 B1
(45) Date of Patent: May 12, 2020

(54) SKATEBOARD

(71) Applicant: Jordan Jacobsma, Templeton, CA (US)

(72) Inventor: Jordan Jacobsma, Templeton, CA (US)

( * ) Notice: Subject to any disclaimer, the term of this patent is extended or adjusted under 35 U.S.C. 154(b) by 0 days.

(21) Appl. No.: 16/288,984

(22) Filed: Feb. 28, 2019

Related U.S. Application Data

(60) Provisional application No. 62/642,485, filed on Mar. 13, 2018.

(51) Int. Cl.
*A63C 17/01* (2006.01)

(52) U.S. Cl.
CPC ..... *A63C 17/011* (2013.01); *A63C 17/015* (2013.01); *A63C 2203/10* (2013.01)

(58) Field of Classification Search
CPC .. A63C 17/011; A63C 17/015; A63C 2203/10
See application file for complete search history.

(56) References Cited

U.S. PATENT DOCUMENTS 1,056,357 A * 3/1913 Murdock ..... A63C 17/01 280/87.042
1,890,755 A * 12/1932 Shepherd ..... A63C 17/01 280/87.03
3,140,522 A * 7/1964 Prout ..... B60P 7/08 403/263
3,430,305 A * 3/1969 Geffner ..... B64D 17/383 24/603
4,029,330 A * 6/1977 Runyan, Jr. ..... A63C 17/0086 280/87.042
4,179,133 A 12/1979 Robb
4,182,520 A * 1/1980 Stevenson ..... A63C 17/01 280/87.042
4,183,546 A * 1/1980 Heilig ..... A63C 17/01 280/11.212
4,198,080 A * 4/1980 Carpenter ..... A61M 39/1011 24/635
4,337,963 A * 7/1982 Stevenson ..... A63C 17/017 280/610
4,537,100 A * 8/1985 Palm ..... B25B 23/0035 403/325
4,663,796 A * 5/1987 Helling ..... B25G 3/20 15/144.2
4,707,884 A * 11/1987 Chang ..... A63C 17/01 16/325
4,732,400 A * 3/1988 Santini ..... A63C 17/01 280/87.042
4,811,971 A * 3/1989 Phillips ..... A63C 17/01 280/87.041
D302,063 S * 7/1989 Frazier ..... D34/17
(Continued)

*Primary Examiner* — Jacob B Meyer
(74) *Attorney, Agent, or Firm* — Eric Karich; Karich & Associates

(57) ABSTRACT

A skateboard has a platform that extends longitudinally from a first end to a second end, the first and second ends being separated by a central portion. The platform body is formed so that the platform is laterally planar, and longitudinally bent upwardly at the first end, and bent downwardly at the second end, relative to the central portion. A first truck mounting structure is provided adjacent the first end, and a second truck mounting structure is provided adjacent the second end.

6 Claims, 4 Drawing Sheets

(56) References Cited

U.S. PATENT DOCUMENTS 4,886,297 A * 12/1989 Levine ..... A63C 17/0006 280/809
4,951,958 A * 8/1990 Chao ..... A63C 17/26 188/16
5,090,716 A * 2/1992 Borden ..... A63C 17/004 280/87.042
5,165,711 A * 11/1992 Tsai ..... B62K 3/002 280/87.041
5,221,111 A * 6/1993 Younger ..... A63C 17/0006 16/426
5,855,385 A 1/1999 Hambsch
5,915,707 A * 6/1999 Steffen ..... A63C 17/0026 280/87.01
6,199,880 B1 * 3/2001 Favorito ..... A63C 17/01 280/14.28
6,213,484 B1 * 4/2001 Rohner ..... A63C 17/01 280/87.042
6,318,741 B1 * 11/2001 Chen ..... B62K 3/002 16/900
6,367,828 B1 * 4/2002 Mandic ..... B60T 1/14 280/87.05
6,435,558 B2 * 8/2002 Osawa ..... A63C 17/004 280/11.27
6,511,083 B1 * 1/2003 Tsai ..... A63C 17/01 280/87.021
6,520,516 B2 * 2/2003 Favorito ..... A63C 17/01 280/87.042
6,935,645 B1 * 8/2005 Fuhrmeister ..... A63C 17/0006 280/809
7,137,925 B2 * 11/2006 Rozycki ..... A63B 69/0093 482/51
7,226,062 B1 * 6/2007 Stefano ..... A63C 17/01 280/87.041
8,500,147 B2 * 8/2013 Johnson ..... B62K 15/006 280/87.021
8,944,440 B2 * 2/2015 Elkinton ..... B63B 35/79 280/14.28
9,278,738 B2 * 3/2016 Elkinton ..... B63B 35/79
2002/0011728 A1 * 1/2002 Osawa ..... A63C 17/004 280/842
2006/0082089 A1 4/2006 Rejtano
2010/0123295 A1 * 5/2010 Landau ..... A63C 17/0046 280/87.042
2010/0304941 A1 * 12/2010 Ota ..... A63C 5/03 482/146
2014/0251072 A1 * 9/2014 LaBrie ..... B62B 5/06 74/551.4
2017/0113121 A1 * 4/2017 Imbrie ..... A63C 17/015
2017/0182398 A1 * 6/2017 Garcia Elena ..... B62M 6/65

* cited by examiner

SKATEBOARD

CROSS-REFERENCE TO RELATED APPLICATIONS

This application for a utility patent claims the benefit of U.S. Provisional Application No. 62/642,485, filed Mar. 13, 2018.

BACKGROUND OF THE INVENTION

Field of the Invention

This invention relates generally to skateboards, and more particularly to a skateboard that can be converted into different forms for different users and for different styles of use.

Description of Related Art

Skateboards generally comprise a platform supported by front and rear pairs of wheels. Sometimes the platform is simply planar, but more commonly the platform is formed so that the board has a top surface that is laterally concave, and longitudinally curved upwardly at its rear end. It may be curved upwardly at its front end too, so that the board may be ridden in either direction.

Because of these shaped features, the board is only used in one configuration, with the trucks of the wheel pairs being installed on the bottom, convex surface of the platform. The board is never configured so that the platform is flipped and ridden with the opposing side facing upwardly.

Importantly, the prior art does not teach a board that is laterally planar, with one end of the platform being angled upwardly, and the other end being angled downwardly. The present invention fulfills these needs and provides further advantages, as described in the following summary.

SUMMARY OF THE INVENTION

The present invention teaches certain benefits in construction and use which give rise to the objectives described below.

The present invention provides a skateboard comprising a platform having a first surface and a second surface that each extend to an outer perimeter. The platform extends longitudinally from a first end to a second end, the first and second ends being separated by a central portion. The platform body is formed so that the platform is laterally planar, and longitudinally bent upwardly at the first end, and bent downwardly at the second end, relative to the central portion. A first truck mounting structure is provided adjacent the first end, and a second truck mounting structure is provided adjacent the second end.

A primary objective of the present invention is to provide a skateboard having advantages not taught by the prior art.

Another objective is to provide a skateboard that can be converted into different forms for different users and for different styles of use A further objective is to provide a skateboard that includes a platform that is curved into a unique shape that enables the skateboard to be configured for different styles of riding and use, by flipping the platform of the skateboard relative to the trucks and wheels of the skateboard.

A further objective is to provide a skateboard that further includes a mounting structure for mounting different additional structures on the skateboard.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a skateboard that can be converted into different forms for different users and for different styles of use.

Figure 1:
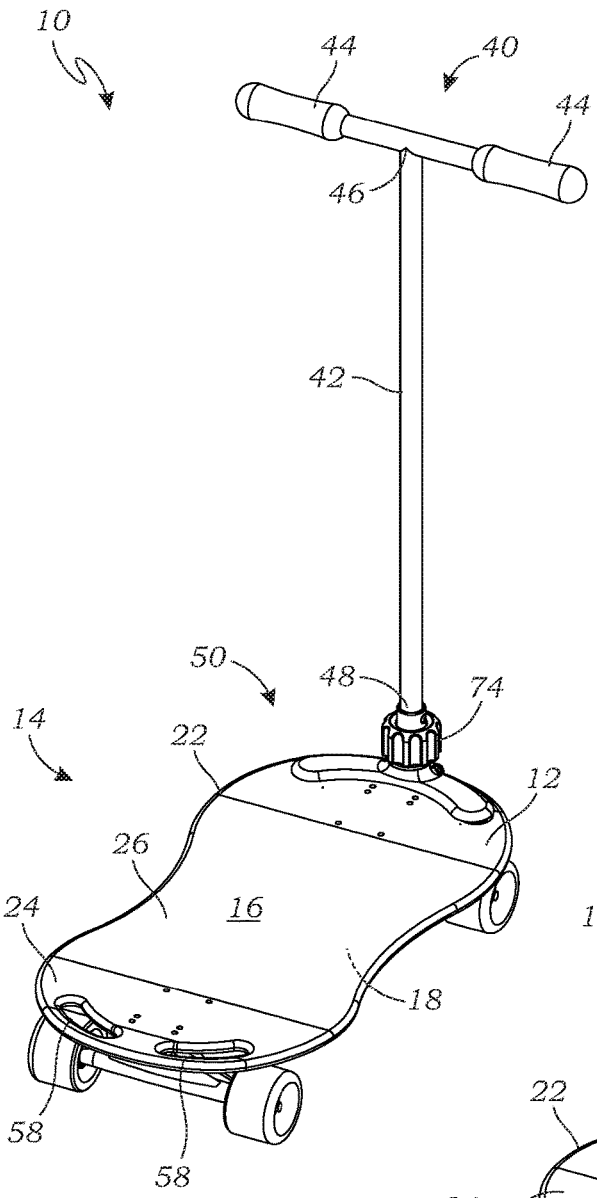
FIG. 1 is a top perspective view of a skateboard according to one embodiment of the present invention.
Figure 2:
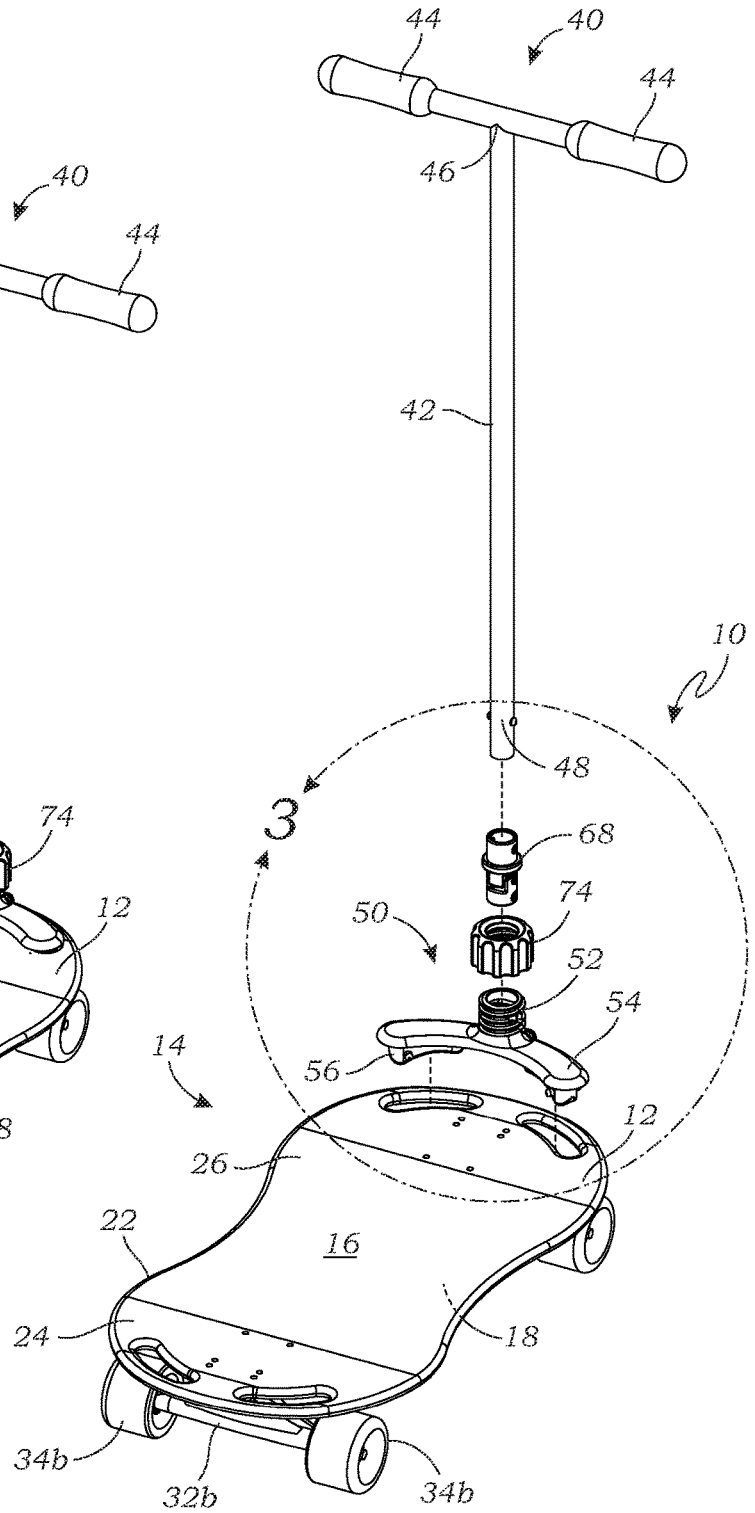
FIG. 2 is an exploded perspective view thereof.
Figure 3:
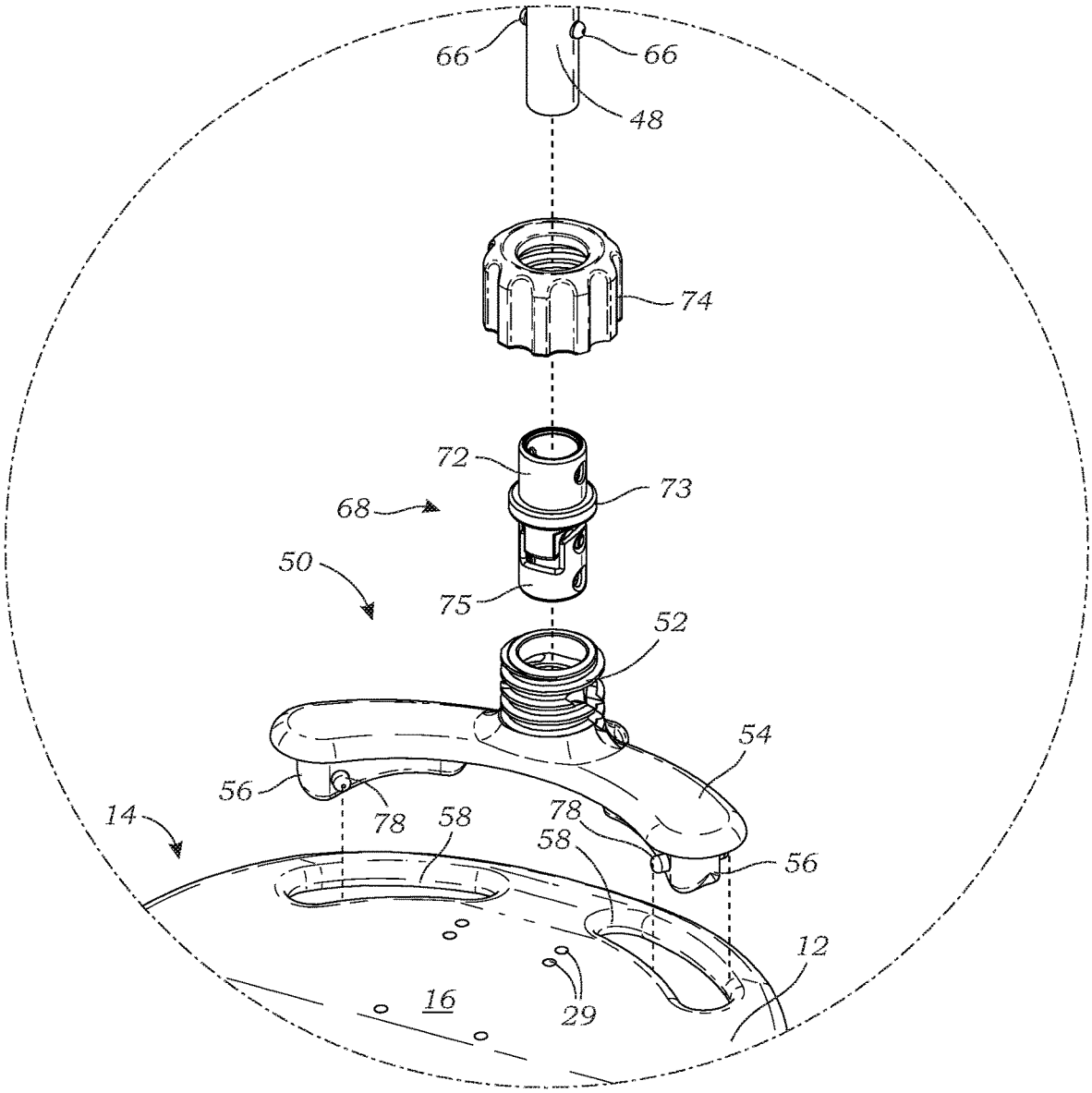
FIG. 3 is a close up exploded perspective view of a first end of the skateboard, illustrating a mounting structure of the skateboard.
Figure 4:
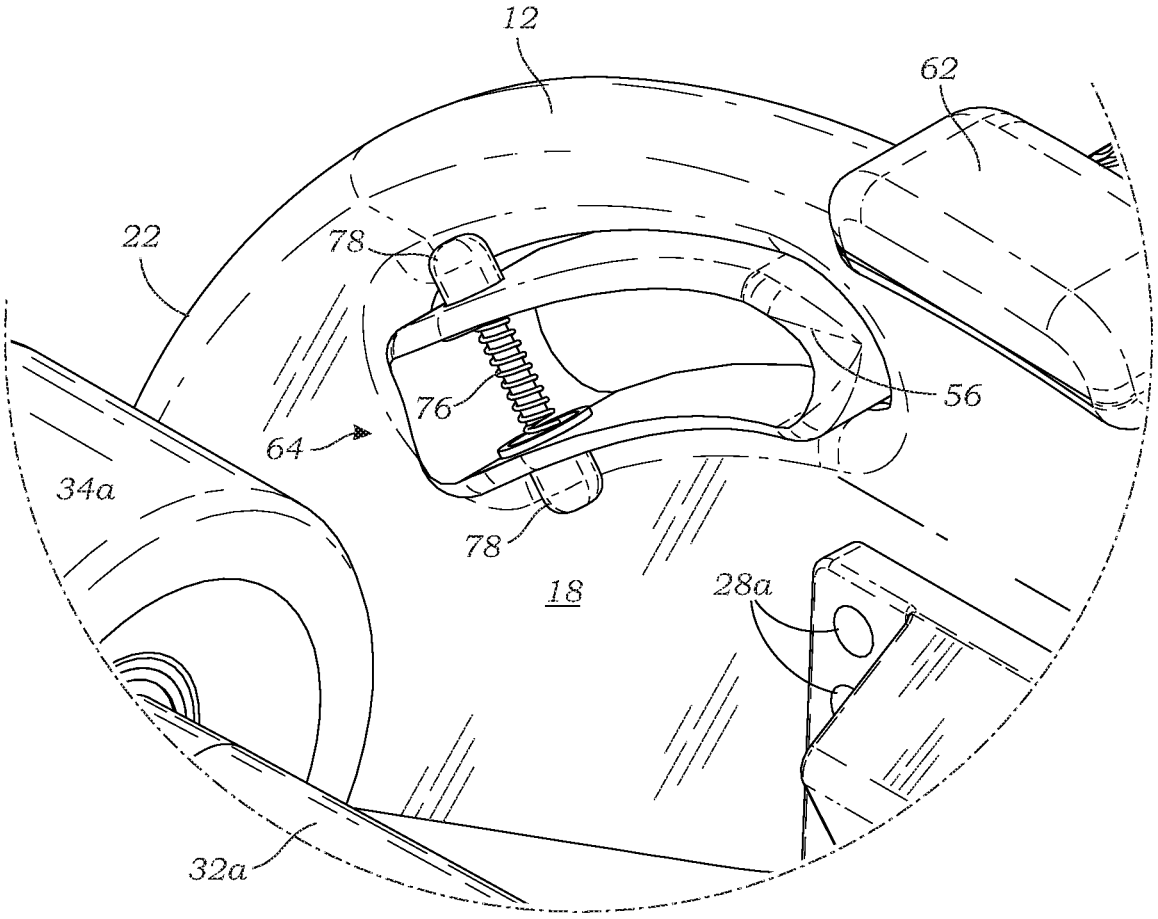
FIG. 4 is a close up bottom perspective view of the first end of the skateboard.

FIG. 1 is a top perspective view of a skateboard 10 according to one embodiment of the present invention. FIG. 2 is an exploded perspective view thereof. FIG. 3 is a close up exploded perspective view of a first end 12 of the skateboard 10, illustrating a mounting structure 50 of a scooter handlebar 40. FIG. 4 is a close up view of a second surface 18 of the first end 12 of the skateboard 10.

As shown in FIGS. 1-3, the skateboard 10 includes a platform 14 having a first surface 16 and the second surface 18 that each extend to an outer perimeter 22. The platform 14 extends longitudinally from the first end 12 to a second end 24, the first end 12 and, in FIGS. 1-2, a second end 24 being separated by a central portion 26. The platform 14 may be any shape desired by the user, although it is typically a generally rectangular, oval, or a similarly useful shape. The platform may be made of any material suitable for supporting a rider, such as wood, plastic, etc.

As shown in FIGS. 3-4, a first truck mounting structure 28*a* is adjacent the first end 12, and a second truck mounting structure 28*b* is adjacent the second end 24. The truck mounting structures 28*a* and 28*b* are typically mounting bolts, which are received by bolt holes 29, although other mounting structures devised by those skilled in the art may also be used.

Figure 5:
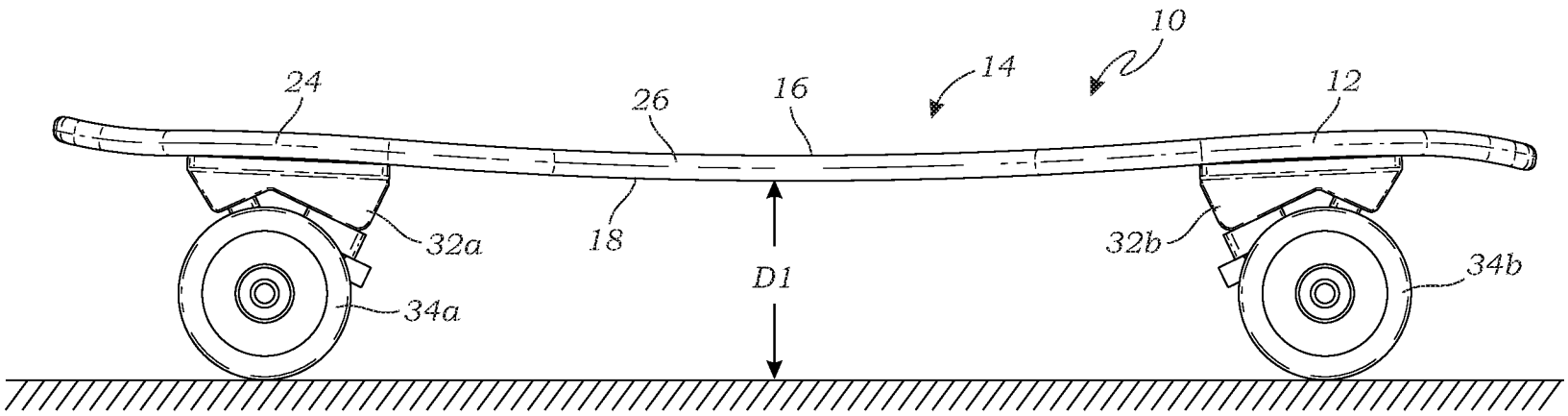
FIG. 5 is a side elevational view of the skateboard in a first configuration.
Figure 6:
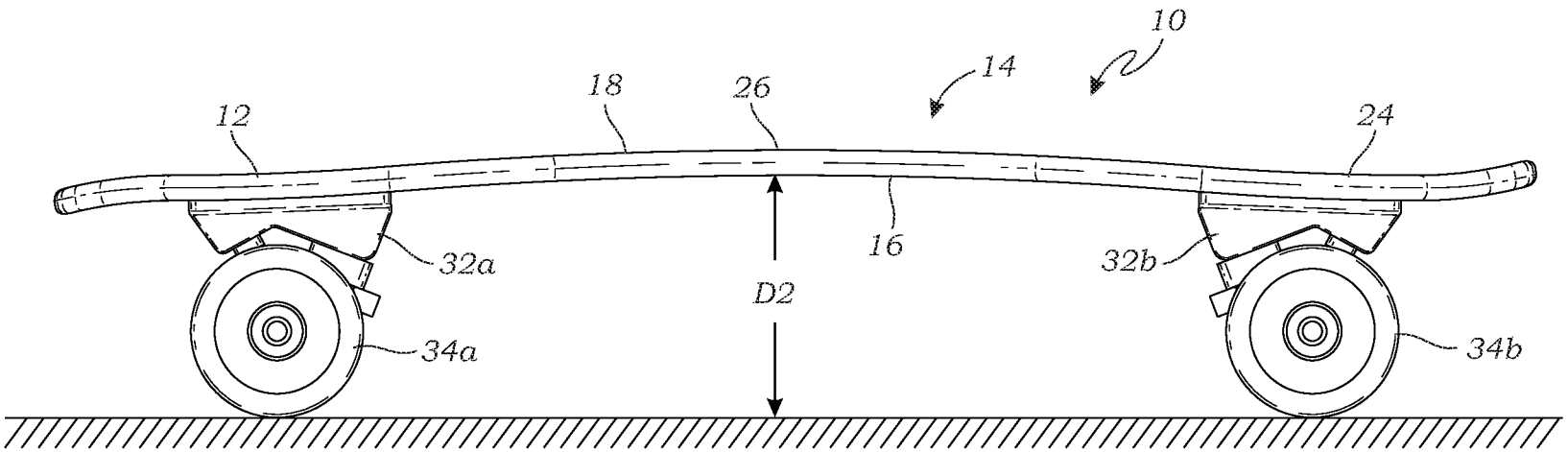
FIG. 6 is a side elevational view of the skateboard in a second configuration.

As shown in FIGS. 1-2 and 4, a first truck 32*a*, for mounting a first pair of wheels 34*a*, is mounted to the platform 14 via the first truck mounting structure 28*a*; and a second truck 32*b*, for mounting a second pair of wheels 34*b*, is mounted to the platform 14 via the second truck mounting structure 28*b*. The first and second truck mounting structures 28*a* and 28*b* are adapted so that the first and second trucks 32*a* and 32*b* may be mounted on the first and second truck mounting structures 28*a* and 28*b*, respectively, on either the first surface 16 or the second surface 18 of the platform 14. This is illustrated in FIGS. 5 and 6, and described in greater detail below. Importantly, only the first and second pairs of wheels 34*a* and 34*b*, positioned at the first and second end 12 and 24 of the platform 14, respectively, contact the ground surface while a user is riding the skateboard 10.

As shown in FIGS. 1-3, the skateboard 10 may be used in conjunction with the scooter handlebar 40 so that the skateboard 10 may be used as a scooter. In this embodiment, the scooter handlebar 40 includes a vertical post 42 with a pair of handles 44 extending laterally from a top end 46 of the vertical post 42. A lower end 48 of the vertical post 42 includes a pair of depressible heads 66 and is engaged with the mounting structure 50. The mounting structure 50 includes, in this embodiment, a cylindrical securing mechanism 68 having a hollow top end 72 sized to receive the vertical post 42 and engage with the pair of depressible heads 66. The top end 72 may be pivotally mounted on a lower end 75, separated by a flange 73 extending outwardly from the top end 72.

The mounting structure 50 may further comprise an externally threaded stump 52 that receives the securing mechanism 68, and a cap 74 that covers the securing mechanism 68 and threadedly engages with the stump 52. In this embodiment, the cap 74 engages the flange 73 of the securing mechanism 68. The externally threaded stump 52 extends from a platform engaging structure 54, which is a rigid plate that curves at the same degree as the perimeter 22 of the platform 14. Shown in FIGS. 2-4, The platform engaging structure 54 may further include a pair of laterally spaced protrusions 56 and a locking lip 62 that extends downwardly and is positioned between the protrusions 56. The pair of protrusions 56 are shaped to frictionally engage a pair of apertures 58 through corners of the platform 14. The platform 14 may include pairs of apertures 58, at the first end 12 and the second end 24, respectively; or a single pair may be included, or other arrangement of apertures that may be desired by one skilled in the art. The apertures 58 are useful for not only mounting different items onto the platform 14, they also provide a place to grab the platform 14 while the skateboard 10 is being ridden in a seated position. In construction, the locking lip 62 fits over the outer perimeter 22 of the first end 12 (or the second end 24, if desired), extending downwardly and angling so that it secures on the underside of the first surface 16 (or the second surface 18, depending on the current configuration), to lock the mounting structure 50 onto the platform 14.

As shown in FIG. 4, the protrusions 56 each include a locking mechanism 64 for removably locking the protrusions 56 within the corresponding apertures 58, to prevent disengagement of the mounting structure 50 from the platform 14. In the embodiment of FIG. 4, the locking mechanism 64 includes a spring 76 and a pair of heads 78, the spring 76 being within the hollow protrusion, and the pair of heads 78 without, so that the heads 78 may be depressed to release the protrusion 56 from the platform 14. While one embodiment of the locking mechanism 64 is illustrated, those skilled in the art may devise alternative embodiments (such as a flange, clip, ring mechanism, etc.) which should also be considered within the scope of the present invention.

The first and second surfaces 16 and 18 may include high frictional material such as grip tape, and may further include a padded tape that may be better for sitting on the platform 14 (i.e., such as when a child is using the board and sitting on it). The padded tape is typically installed over the central portion 26, where a child may often sit while riding the skateboard 10 from a seated position. A marking coating may also or alternatively be included over a portion of the skateboard 10 which may be used for marking on the skateboard 10 (e.g., with dry-erase markers, chalk, etc.). In one embodiment, both the platform 14 and the wheels 34*a* and 34*b* may be covered in a dry-erase marking coating, to allow a user to decorate the skateboard 10 as desired.

FIG. 5 is a side elevational view of the skateboard 10 in a first configuration, where the first and second trucks 32*a* and 32*b* are mounted on the first surface 16 of the platform 14. FIG. 6 is a side elevational view of the skateboard 10 in a second configuration, where the first and second trucks 32*a* and 32*b* are mounted on the second surface 18 of the platform 14. As shown in FIGS. 5 and 6, the platform body is formed so that the platform 14 is laterally planar, and longitudinally bent in opposite directions at the first end 12 and second end 24, relative to the central portion 26 and current truck configuration.

In the embodiment of FIGS. 5 and 6, the central portion 26 of the platform 14 is longitudinally bent to curve in an arc between the first and second truck mounting structures 28*a* and 28*b*. In the first configuration, shown in FIG. 5, this results in the central portion 26 being spaced a first distance D1 that is small, so that the central portion 26 is close to the ground. In the second configuration, shown in FIG. 6 (once the board has been flipped over), this results in the central portion 26 being spaced a second distance D2 that is larger than D1, so that the central portion 26 is further from the ground. This enables the user to modify the configuration of the skateboard 10 between two different modes of use by flipping the platform 14 of the skateboard 10 relative to the trucks 32*a* and 32*b*. In either case, the ends form In FIGS. 5 and 6, the skateboard 10 is illustrated without the scooter handlebar 40 of FIGS. 1-3, illustrating the easy customization of the skateboard 10 for different modes of use.

The mounting structure 50 described above may also be used for mounting alternative accessories to the skateboard 10 aside from the scooter handles 44. For example, camera devices such as a GOPRO® may be mounted onto the skateboard 10, or any desired object that may be attached via the mounting structure 50, such as a seat attachment, a wagon handle, a basket, etc. Those skilled in the art may devise a wide range of objects or structures that a user may want to removably attach to the skateboard, and any such object or structure should be considered within the scope of the present invention.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A skateboard comprising:

a platform having a first surface and a second surface that each extend to an outer perimeter, the platform extending longitudinally from a first end to a second end, the first and second ends being separated by a central portion;

the platform body formed so that the platform is laterally planar, and longitudinally bent upwardly at the first end, and bent downwardly at the second end, relative to the central portion;

a first truck mounting structure adjacent the first end;

a second truck mounting structure adjacent the second end;

further including a mounting structure comprising:

a cylindrical securing mechanism having a hollow top end sized to receive a vertical post, the top end being pivotally mounted on a lower end, separated by a flange extending outwardly from the top end;

an externally threaded stump that extends from a platform engaging structure;

a cap that fits over the securing mechanism and threadedly engages with the externally threaded stump;

wherein the platform engaging structure is a curved rigid plate that comprises a pair of laterally spaced protrusions and a locking lip that extends downwardly and fits over the outer perimeter of the platform, angling so that it secures on the underside of the platform to lock the mounting structure onto the platform, further being positioned between the protrusions, the protrusions being shaped to frictionally engage a pair of apertures through corners of the platform.

2. The skateboard of claim 1, further comprising a first truck for mounting a first pair of wheels, and a second truck for mounting a second pair of wheels, and wherein the first and second truck mounting structures are adapted so that the first and second trucks may be mounted on the first and second truck mounting structures, respectively, on either the first or second surface of the platform.

3. The skateboard of claim 1, wherein the central portion of the platform is longitudinally curved between the first and second truck mounting structures.

4. The skateboard of claim 1, further comprising a marking coating for marking on the skateboard with a marker.

5. The skateboard of claim 1, further comprising a marking coating on both the platform and the wheels.

6. A skateboard comprising:

a platform having a first surface and a second surface that each extend to an outer perimeter, the platform extending longitudinally from a first end to a second end, the first and second ends being separated by a central portion;

the platform body formed so that the platform is laterally planar, and longitudinally bent upwardly at the first end, and bent downwardly at the second end, relative to the central portion;

a first truck mounting structure adjacent the first end;

a second truck mounting structure adjacent the second end;

a first truck having a first pair of wheels mounted on the first truck mounting structure;

a second truck having a second pair of wheels mounted on the second truck mounting structure;

wherein the central portion of the platform is longitudinally bent between the first and second truck mounting structures to form an arc; and high frictional grip tape material on both the first and second surfaces of the platform.

* * * * *